US006363689B1

(12) United States Patent
Rodriguez et al.

(10) Patent No.: US 6,363,689 B1
(45) Date of Patent: Apr. 2, 2002

(54) BANDING MACHINE

(75) Inventors: Peter A. Rodriguez, Jax; Thomas B. Middlebrooks, Jax Beach, both of FL (US)

(73) Assignee: Sandar Industries, INC, Atlantic Beach, FL (US)

( * ) Notice: Subject to any disclaimer, the term of this patent is extended or adjusted under 35 U.S.C. 154(b) by 0 days.

(21) Appl. No.: 09/491,859

(22) Filed: Jan. 26, 2000

(51) Int. Cl.[7] ..... B65B 13/06; B65B 13/32

(52) U.S. Cl. ..... 53/399; 53/589; 100/2; 100/26; 100/29

(58) Field of Search ..... 100/2, 7, 26, 29, 100/32, 33 R; 53/399, 589

(56) References Cited

U.S. PATENT DOCUMENTS 3,949,662 A * 4/1976 Woomer ..... 100/29
4,020,756 A * 5/1977 Weiss ..... 100/29
4,254,703 A * 3/1981 Fulton et al. ..... 100/2
4,661,185 A * 4/1987 Kobiella ..... 100/29
5,146,847 A * 9/1992 Lyon et al. ..... 100/26
5,172,179 A * 12/1992 Tani et al. ..... 100/26
5,560,180 A * 10/1996 Rodriguez et al. ..... 100/29
5,797,242 A * 8/1998 Sauer ..... 100/26

FOREIGN PATENT DOCUMENTS

DE 3610631 A * 10/1987 ..... 100/33 R
SU 923900 A * 4/1982 ..... 100/33 R

* cited by examiner

*Primary Examiner*—Stephen F. Gerrity

(57) ABSTRACT

Method and apparatus for tying bundles with baleband made of paper pulp fibers and water-soluble adhesive. The machine is positioned transverse to a conveyor upon which bundles are moved into position for tying. The machine includes a track for guiding the baleband around the bundle, applying water to the forward end of the baleband, clamping the forward end of the bale band, tightening the baleband around the bundle, pressing the forward end against an overlapped portion of the baleband while heating the end of the baleband to seal the ends together, pressing the ends together and cutting the overlapped portion of the baleband and releasing the bundle for unloading from the conveyor.

20 Claims, 11 Drawing Sheets

BANDING MACHINE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to apparatus for packaging bales of material and particularly to packaging bales of cellulose pulp utilizing a repulpable baleband.

2. Description of Related Art

A wide variety of banding machines are known to the prior art. Many of these machines employ a metal wire or band as a securing element. The wires or band must be removed before pulping of the cellulose pulp bale. A machine that employs a repulpable cellulose baleband is disclosed in U.S. Pat. No. 5,560,180. Improvements in this technology are needed to provide greater precision, speed and economy in the bale banding process.

BRIEF SUMMARY OF THE INVENTION

In one aspect of the present invention there is provided a banding machine for cooperation with and between an upstream and a downstream horizontal conveyor upon which loose bales of material are moved to be wrapped into tight bales including a support frame locatable transversely with respect to a longitudinal direction of the conveyors and between the conveyors, the banding machine having an arched track with spaced vertical and horizontal members for guiding a band transversely and completely around a loose bale disposed within the arched track. The banding machine includes a sealing station adjacent one vertical member and has an automatic means for selectively gripping a forward end of a band. The sealing station has a reversible drive wheel for driving a band forward through the track with an overlap of a band located adjacent one vertical member and for applying reverse force to tighten a band around a bale after actuation of the automatic means for selectively gripping. The sealing station also has means for connecting overlapped end portions of the band after tightening the band about a bale and means for cutting the band as overlapped end portions are connected. The means for connecting including means for applying heat to an inner surface of the band adjacent a portion thereof, means for clamping a forward end portion and another end portion of a band adjacent the forward end portion thereof to secure the band together by adhesive contained in the band.

In other aspects of the invention the reversible drive wheel is located adjacent an inner surface of the band, a movable surface located adjacent an outer surface of the band, the movable surface being selectively movable toward and away from the drive wheel to grip and release a band. The means for connecting includes means for clamping overlapped end portions of a band, the clamping means including a plate located outwardly of a band encircling a bale and an automatic pressing head disposed inwardly of a band generally opposite to the plate, the sealing station having a horizontal exit slot for a band between the plate and the pressing head opening toward a downstream movement of a bale from the machine by one conveyor causes a band encircling a bale to move out through the exit slot. Also included is means for applying water to a portion of a band, the water cooperating with the adhesive in a band for securing the two portions of a band together. The means for applying heat includes a movable heater element selectively positioned between a forward end portion and another end portion of a band. The means for clamping pushes the portions of a band together with the heater element from between the portions before the means for cutting is operated.

In other aspects of the present invention there is provided a method for tying a bundle of material, which includes the steps of: A. encircling a bundle of material with a length of flat band wherein the length has a pre-moistened leading end portion and a trailing end portion partially enclosed in a movable sealing head station and the remaining central portion of the length is partially enclosed in an arched track located concentrically outside the bundle of material; B. clamping the leading end portion to restrain rearward movement of the band while pulling the trailing end portion of the band to concentrically collapse the band from the arched track and tightly encircle the bundle with the trailing end portion of the band overlapping a leading end portion; C. clamping the trailing end portion to prevent loss of tension in the band; D. moving a heated member in between the leading and trailing portions of the band with a press to aid in heat transfer from said member to the leading and trailing portions of the band; E. removing press clamp and retracting heated member from the leading and trailing portions of the band together to form a seal with a hardened flat press that, enroute to perform the act of sealing, shears the trailing portion of the band against a hardened shear edge. The bundle of material is cellulose pulp and the band is of repulpable paper fibers and contains an adhesive that is water-soluble.

Further aspects of the present invention include a banding apparatus for cooperation with and between an upstream and a downstream horizontal conveyor upon which loose bales of material are moved to be wrapped by said apparatus into tight bales comprising a support frame adapted and arranged to be disposed to a longitudinal direction of and between an upstream and a downstream conveyor, a banding machine mounted on the platform, a supply of a stiff flat band of repulpable paper fibers held together with water-soluble adhesive having inner and outer surfaces, the banding machine including an arched track having spaced vertical and horizontal members for guiding the band transversely and completely around a loose bale disposable within the arched track, sealing means adjacent one vertical member for connecting the band to itself. The sealing means includes automatic means for selectively gripping the forward end portion of the band after passing completely through the arched track, the sealing means including a reversible drive wheel for driving the band forward through the track with an overlap of the band adjacent one vertical member and for applying reverse force on the band to tighten the band around a bale after actuation of the automatic means, means for applying water to the forward end portion of the band included and also means for clamping the forward end portion and another portion of the band overlapped therewith after tightening thereof, together with the adhesive being located in the portions and the clamping means including means for cutting the band as the portions are tightly secured by the adhesive. The sealing means includes a heater element for heating at least one portion of the band. The track includes a support member, and movable covering means over support member for removably securing the band to the support member. There is also lifting means for selectively moving the sealing means vertically. The sealing means includes control means for moving the heater element to a position between the portions of the band adjacent the front end portion where water was applied, the heater means heating the wetted adhesive, and said sealing means removing the heater element from between the portions of the band before the means for clamping secures the forward end portion to the another portion. The control means includes means for removing the heater element from between the portions of the band before the means for cutting cuts the band.

The means for clamping the band includes a plate located adjacent the outer surface of the band and an automatic pressing head adjacent the inner surface of the band, the sealing means has a horizontal exit slot for the band about a bale in downstream direction of movement of a bale from the track whereby movement of a bale by the downstream conveyor causes the band encircling a bale to remove out through the exit slot. The means for gripping includes a selectively operable brake member for selectively securing the forward end portion of the band between the brake member and the plate and also includes a second selectively operable brake member for selectively securing another portion between the second brake member and the plate. The reversible drive wheel is located adjacent an inner surface of the band, an engaging surface is located opposite to the drive wheel adjacent the outer surface of the band, the engaging surface being automatically movable toward and away from each other to grip and release the band.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION INTRODUCTION

Figure 1:
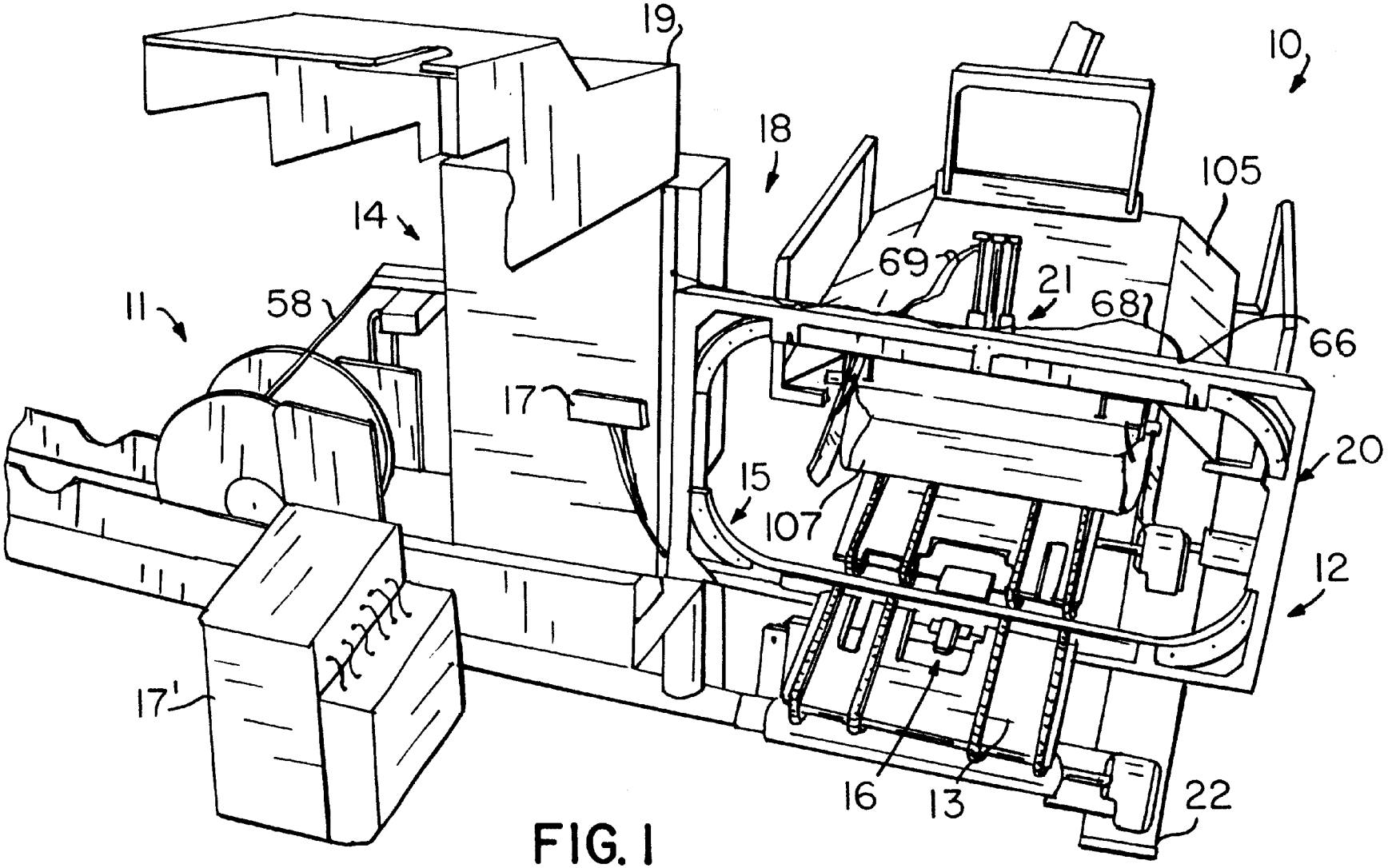
FIG. 1 is a perspective view of the banding machine in accord with the present invention positioned transverse a bale-carrying conveyor system.

The present invention is a baling system that was developed as a means to secure pulp bales with a non-contaminating repulpable baleband, thereby eliminating the need for steel wires and the resultant problems associated with them. The baleband is a strong, fully repulpable product that does not need to be separated from the pulp bales before re-pulping.

The system utilizes a series of hydraulic motors and cylinders, pneumatic actuators and electronically controlled valves to load, feed, band and seal baleband around standard bales of pulp. All machine operations are controlled by a programmable logic controller (PLC). In addition to actual machine functions, the computer interfaces with the host mill's conveyor system to assure uninterrupted progression of product to the banding unit.

The system consists of two major units machinery:

The Unwind unit stores and controls a coil of a baleband preferably for 8 hours of continuous operation and may be about 20,000 feet in length.

A hydraulic motor rotates the coil of band at a rate determined by its diameter at any given time. An angle transducer on the station allows the PLC to compute the proper number of coil revolutions needed to maintain an adequate supply of baleband in the dispenser.

The dispenser unit is composed of three parts. First, a load system provides a ready supply of unwound baleband in a temporary storage assembly known as the loop storage magazine. The load system includes the magazine to which is provided baleband via a load motor that engages the baleband through a pneumatic nip cylinder. The baleband in the loop storage magazine at any given time is at least enough to circle the package twice. Second, a feed system pulls the baleband from the loop storage magazine and directs it into a feed track segment via a reversible feed motor that engages the baleband with a second nip cylinder. Third, a dispenser head system receives the baleband from the feed system and controls all sealing and cutting functions.

The basic operation of the system is as follows. Beginning in manual operation, a baleband is loaded from the unwind system and into the load motor nip and from there to the loop storage magazine. The front edge of the baleband is fed to the feed motor nip. When the system is now placed in automatic, the unwind station will provide additional baleband to the load motor nip where tension is maintained by the load motor. With additional baleband provided by the unwind station, the feed motor begins turning in the forward direction pulling baleband through the feed motor nip. An optical encoder monitors feed motor rotation and direction. The baleband is then pushed into the dispenser head via a baleband pathway and from there to a generally rectangular track assembly. The package rests on the dispenser head and is surrounded by the track assembly. The forward portion of the baleband is wetted by a water injector positioned on the track assembly.

The forward portion of the baleband is pushed through the track assembly by the feed motor to the opposite side of the dispenser head and positioned above the trailing portion of the baleband. A rear brake engages the forward portion of the baleband and holds it stationary.

At this time, the feed motor is reversed causing the baleband to be pulled out of the track assembly and positioned around the package until the feed motor stalls from tension. The optical encoder measures both the rate and amount of pullback. During pullback the dispenser head is raised to the bottom of the bale and a horizontally movable heater is placed between the two sections of baleband and upon reaching the aforementioned tension a front brake is applied to the trailing portion of the band to maintain the tension during the cutting and sealing process. The main press is applied lightly to clamp the heater between the two portions of the band to facilitate heat transfer and then released. The heater is moved back to its initial position and clear of the bands. The main press is applied again under high pressure to shear the trailing edge of the band against a shear edge in its traverse across the span in which the heater previously occupied and to clamp the now hot and tacky leading and trailing edges of the band together to make a joint. The resulting joint has no trailing edge on the outside that can be peeled off due to the dual cutting and sealing duties of the main press. The front and rear brakes 38 and 40 are released, the package is moved forward on the conveyors sliding the band out of the dispenser head and the dispenser head is lowered to home position for a system reload.

SYSTEM CONSTRUCTION

Figure 2:
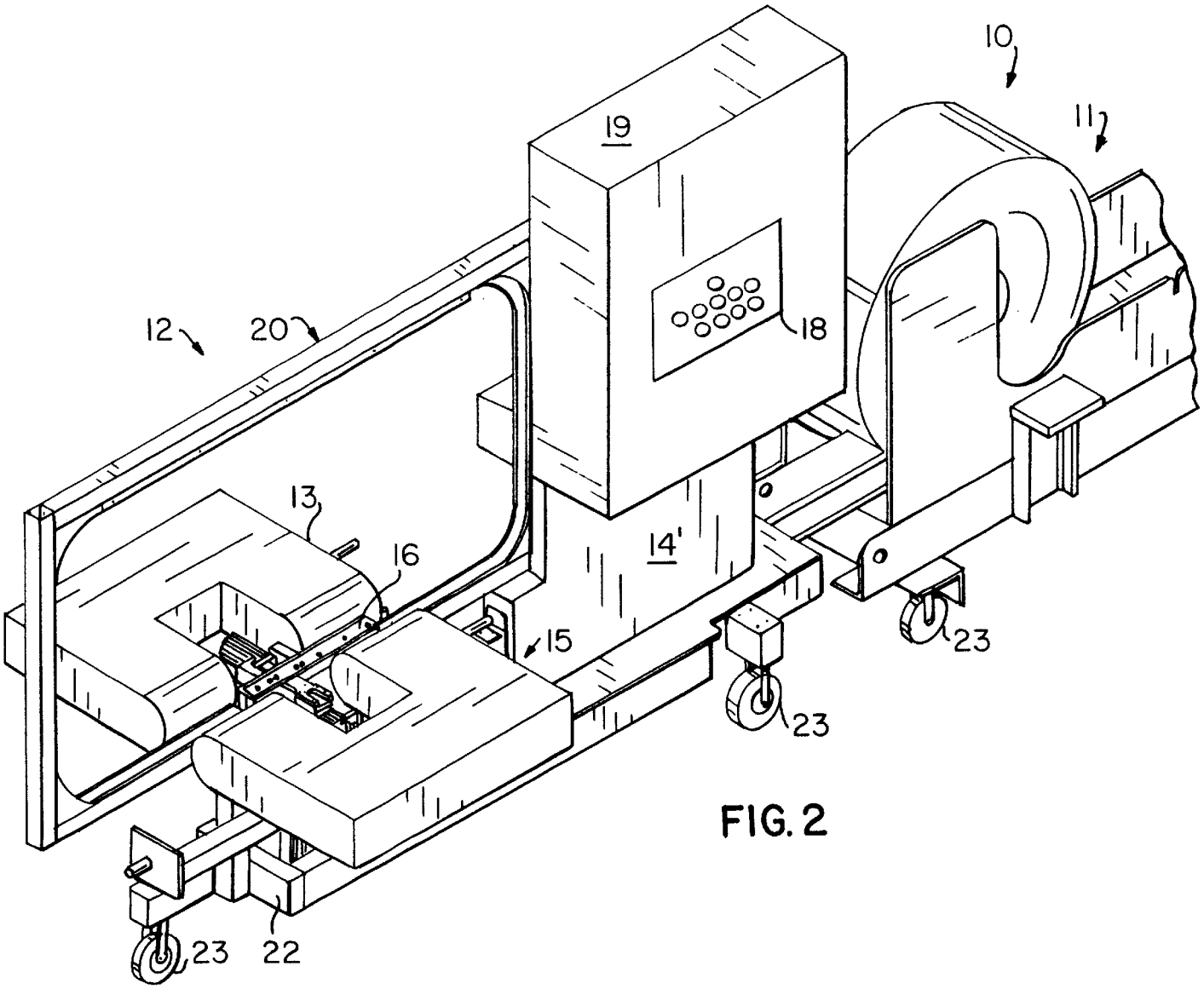
FIG. 2 is another perspective view of the banding machine of FIG. 1.

With respect now to the drawings, the banding machine according to the present invention is depicted generally at 10 in FIGS. 1 and 2. The unwind station is designated generally at 11 and is physically distinct from the dispenser system generally at 12. A conveyor system shown at 13 is not part of the present invention but is supplied by the host mill in which machine 10 is used.

Figure 3:
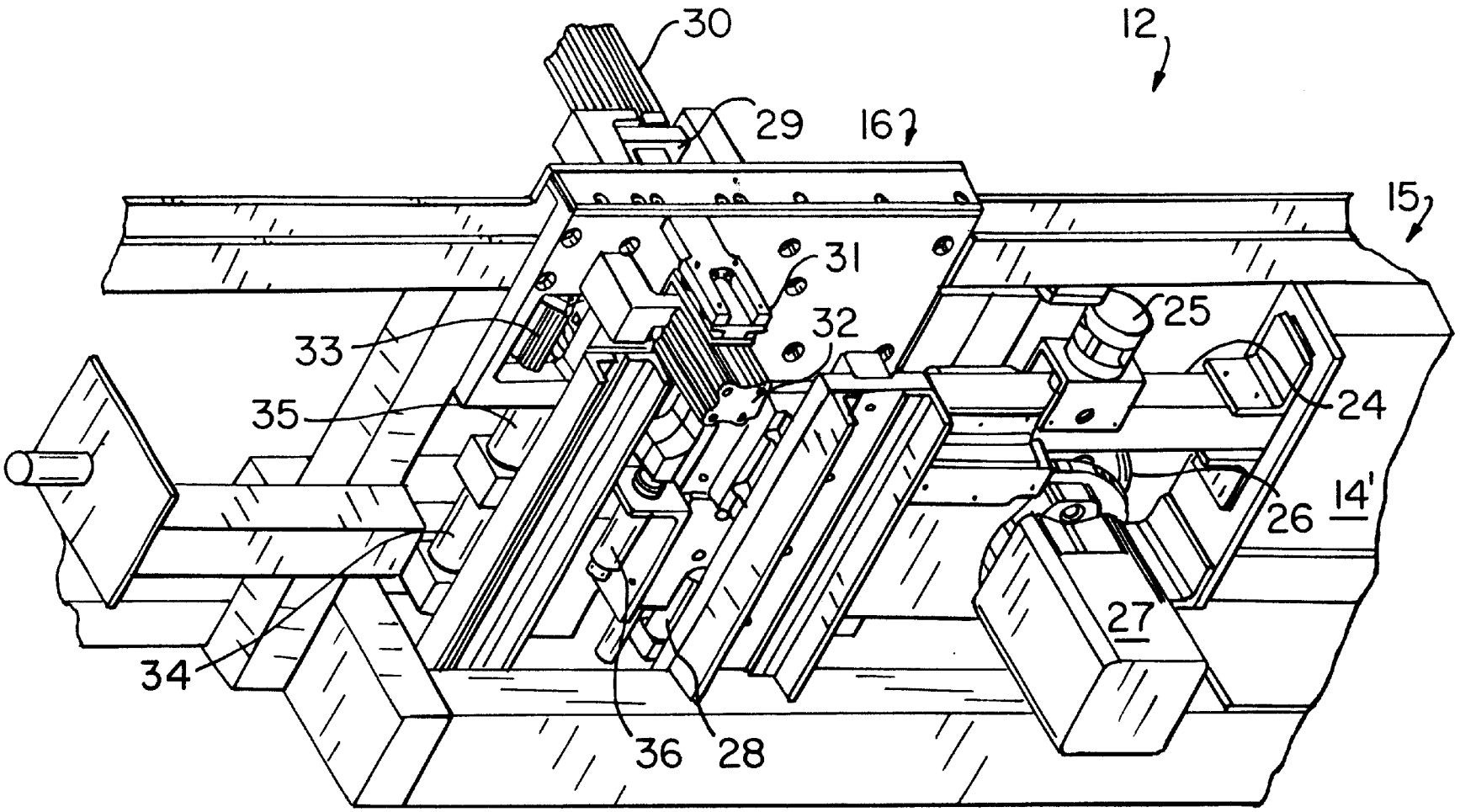
FIG. 3 is a partial detail view of the dispensing station portion of the banding machine of FIGS. 1–2.
Figure 4:
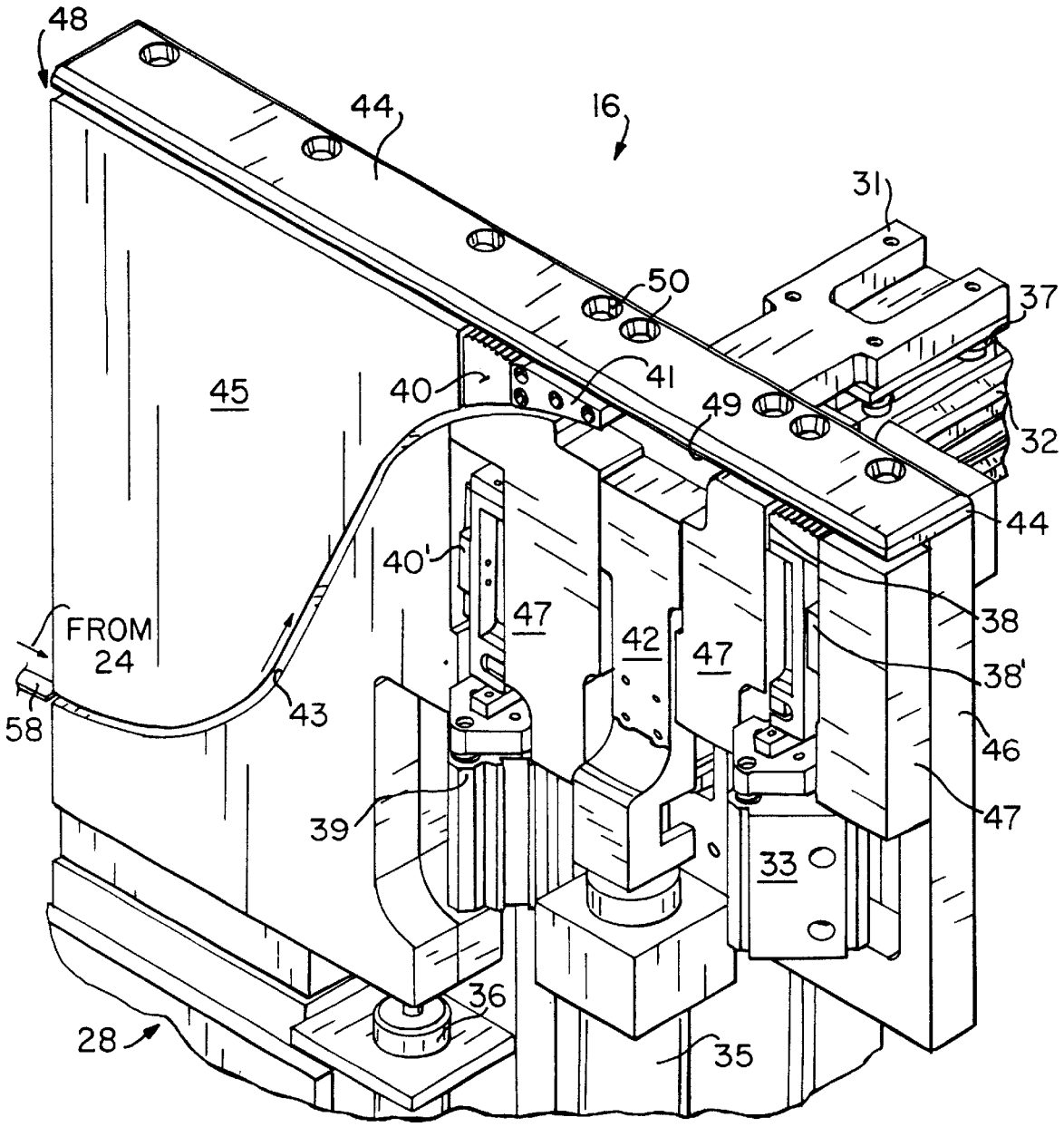
FIG. 4 is another partial detail view of the dispensing station of FIG. 3.

Load system 14 includes loop storage magazine 14' and receives baleband 58 from unwind station 11 and provides it to feed system 15. Dispenser head 16 is shown only generally as are air distribution panel 17 and hydraulic system 17' and the electric control panel 18 and enclosure 19. The track assembly 20 receives pulp bales therein from bale handling apparatus 21. The dispenser station 12 and unwind station 11 are each mobile via a frame 22 that rides on rollers 23. More detail of the dispenser station 12 is given in FIG. 3. Feed system 15 receives baleband (not shown) via feed track segment 24 where it is grasped and pulled by nip cylinder 25 and feed motor engaging wheel 26 driven by hydraulic motor 27. Baleband is provided to dispenser head 16, which includes a main head lift cylinder 28 for moving the dispenser/sealing head 16 upwardly during pullback of the baleband. Baleband path block 29 is movable horizontally via cylinder 30 into a space (not shown) to provide for proper guidance of the baleband through the head 16 and into the track assembly 20. When block 29 is retracted outwardly as shown, a thermoelectric heater tongue 31 can be moved horizontally to a position between forward and trailing ends of the baleband via cylinder 32. Heater tongue 31 is heated to approximately 600 degrees F. for baleband sealing. Front brake cylinder 33 and joint head press cylinders 34 and 35 are also shown. Shock absorber 36 controls downward movement of head 16 via lift cylinder 28. A safety cover for tongue 31 is not shown.

Front brake 38 is movable by front brake cylinder 33 and rear brake 40 is movable via cylinder 39. Guides 38' and 40' provide for proper movement of the respective brakes 38 and 40. Cutter 41 provides a shear force cutting edge for baleband 58 that has been moved through path 43 when joint press head 42 is moved upwardly by hydraulic secondary press cylinder 35 as will be discussed hereinbelow. Frame plates 47 are slideably engaged by head plate 46 that is movable vertically by main lift assembly 28. Path plate 45 has path 43 machined therein and rests on shock absorber 36 and main lift assembly 28. Baleband exit slot 48 is formed between frame members 45, 47 and bale contact head 44 which is attached to movable frame member 46 via bolts 50. Joint press head operating space 49 exists between press head 42 and beveled anvil plate 44. The space 49 is also the space in which baleband path block 29 and heater tongue 31 operate as will be discussed more detail hereinbelow.

Figure 5:
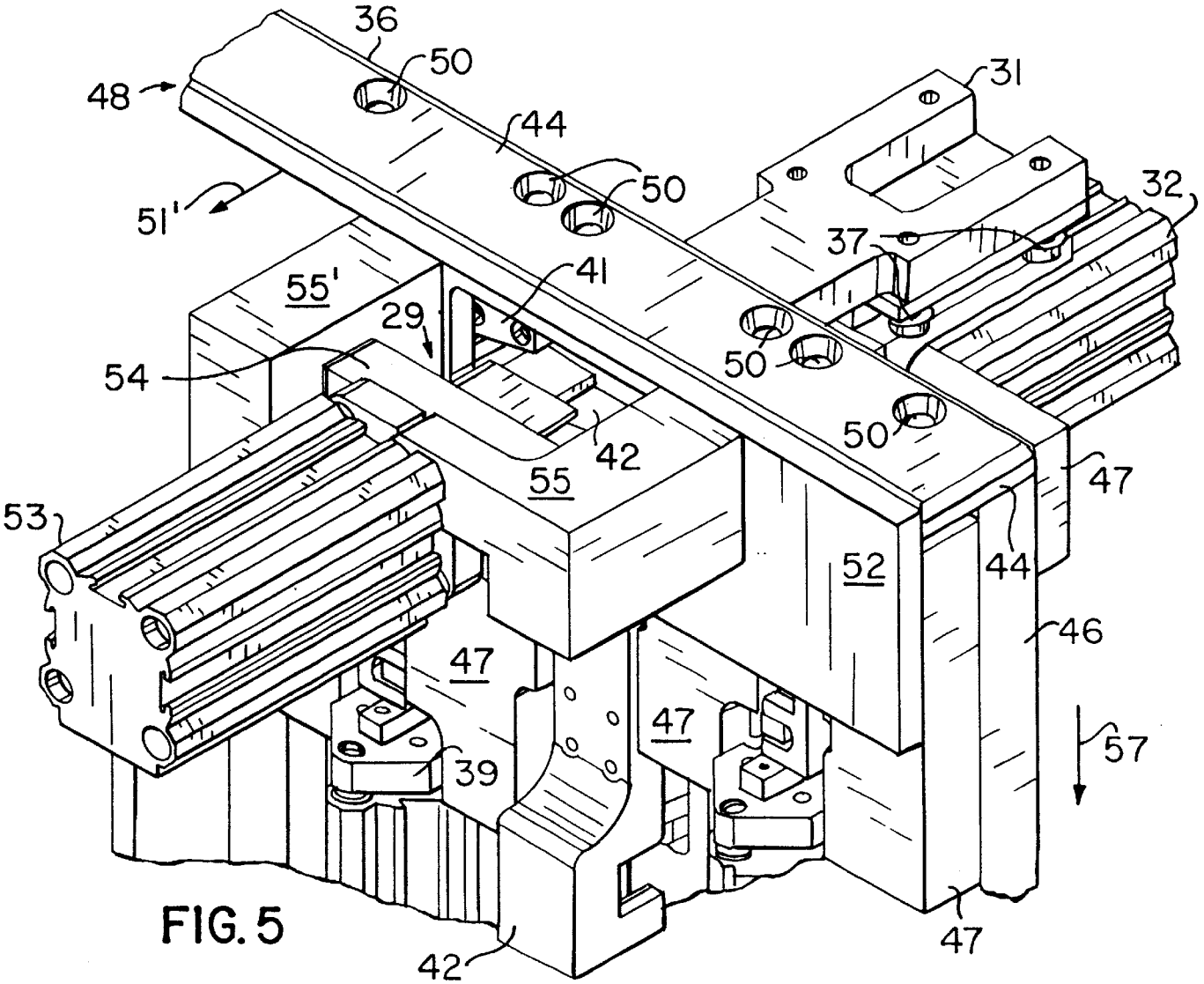
FIG. 5 is a perspective of the sealing head of the dispenser station of FIGS. 3–4 shown in the down position.
Figure 6:
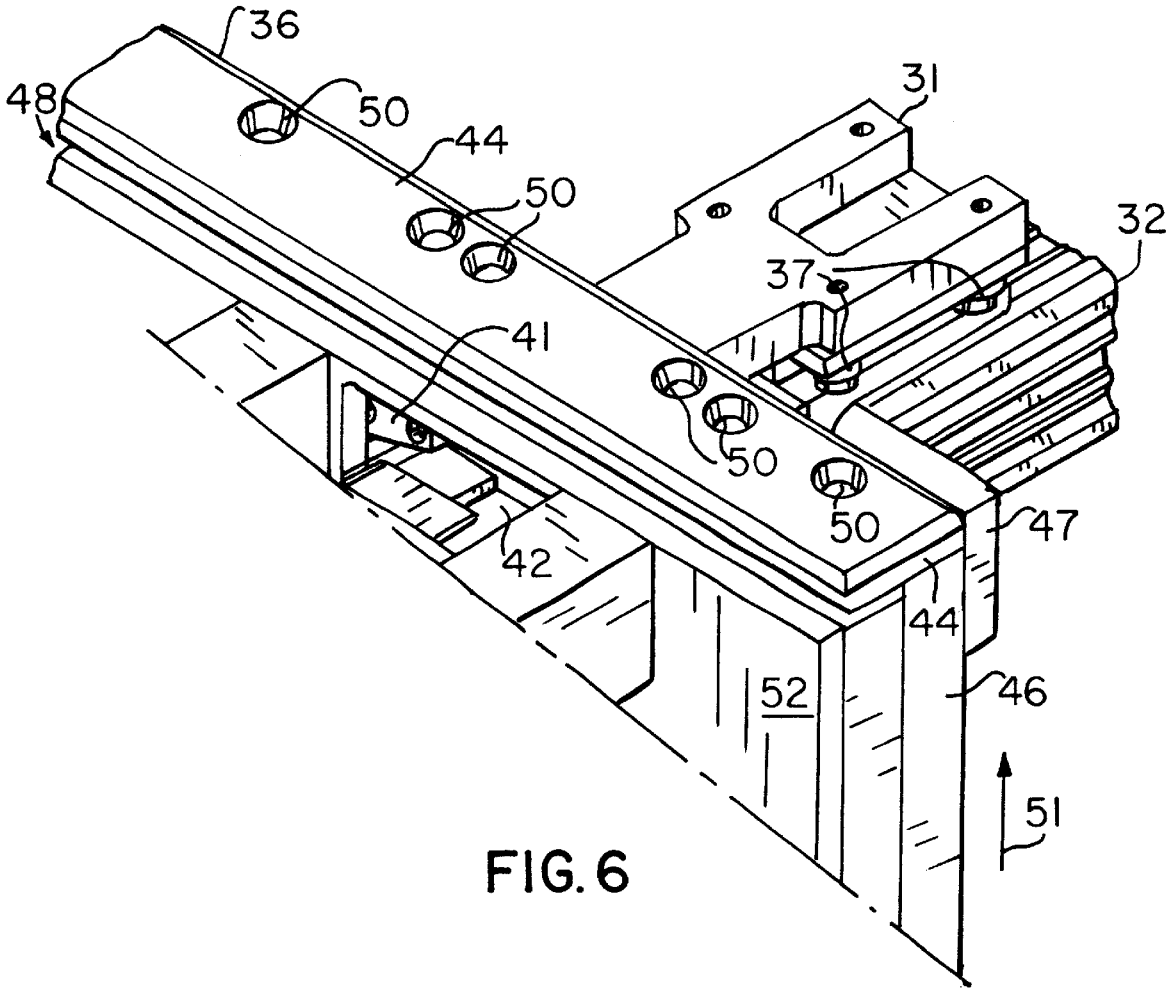
FIG. 6 is a partial illustration of the sealing head of FIG. 5 shown in the raised position.

FIGS. 5 and 6 provide additional detail of part of the dispenser head 16 shown movable upwardly and downwardly as indicated by arrows 51, 57. Baleband block 29 is comprised of plates 54,56 movable by cylinder 53 mounted to head back plate 52 via bracket 55 and bracket 55'. The baleband exit slot 48 provides exit space for the sealed baleband 58 in the direction of arrow 51' when head assembly 46 is moved upward vertically arrow 51 to clear back plate 52 as shown in FIG. 5. In FIG. 5, head assembly 46 is down (arrow 57) showing closed exit slot 48 which functions as part of baleband path 43 through the dispenser head 16.

Figure 7:
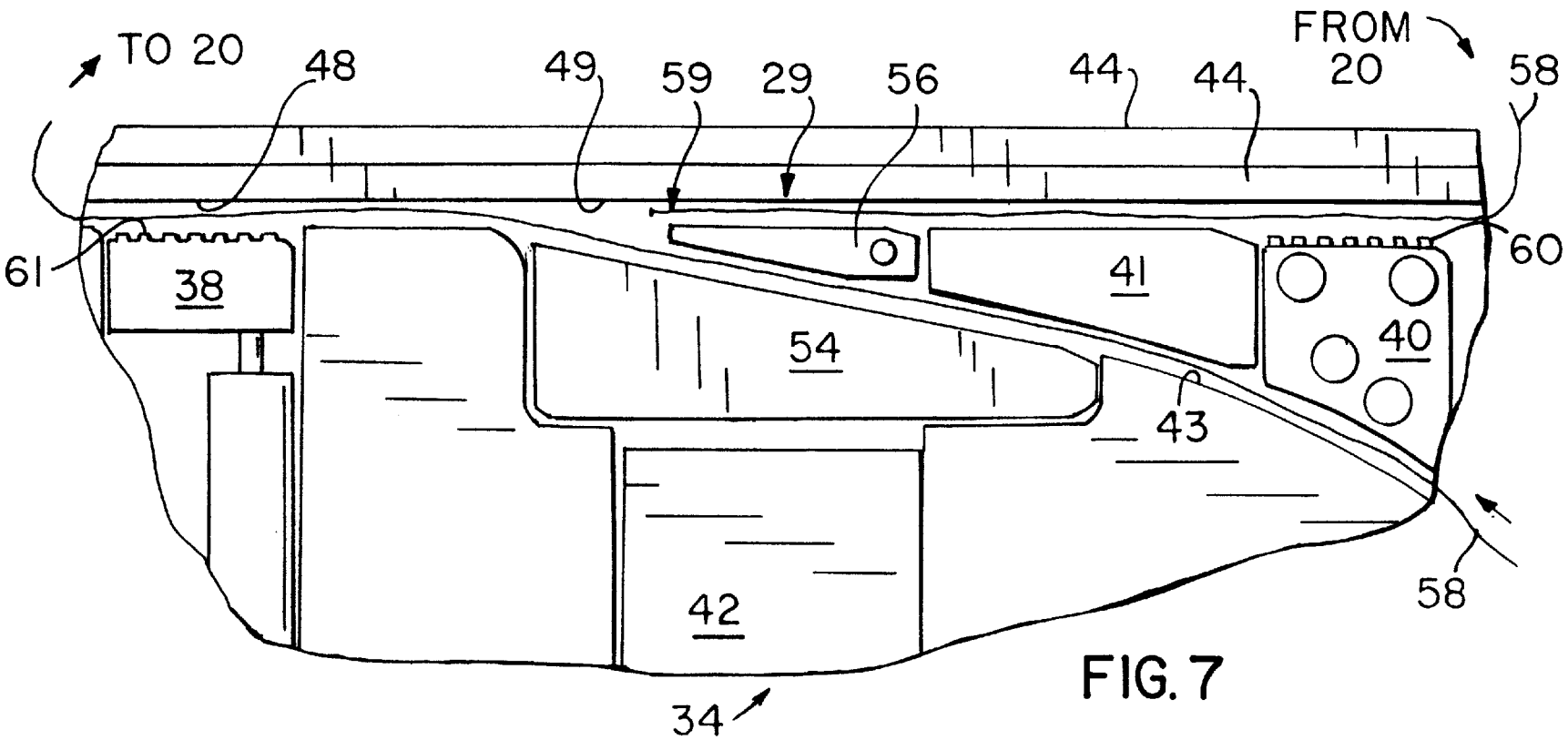
FIG. 7 is a side elevation pictorial view of a portion of the sealing head of FIGS. 5–6.

FIG. 7 illustrates in pictorial form the relative position of some of the major components of the head 16. Baleband 58 is sent into head 16 via baleband path 43 from feed system 15. Baleband block 54 provides guidance for the baleband 58 as it crosses over joint head press 42 in operating space 49. The baleband 58 is directed over front brake 38 having engaging teeth 61 and into track assembly 20. The baleband is returned from track assembly 20 and over rear brake 40 having engaging teeth 60. Feed motor 27 is then stopped in response to encoder 67 (FIG. 8) to place leading edge portion 59 of baleband 58 over joint press head 42. At this time, the rear brake 40 moves upwardly to engage the baleband 58 against anvil head plate 44. Block 29 is retracted after loading (the same time rear brake 40 is activated). Feed motor 27 is then reversed in direction to pull the baleband backwards through path 43 causing it to be pulled out of track assembly 20. Motor 27 is controlled to limit the pullback force to that which is expected for a standard package. (Excessive pullback, detected as a function of length by encoder 62 is indicative of a malfunction such as baleband breakage.) Once pullback is complete, front brake 38 is moved upward to engage the baleband 58 between teeth 61 and anvil head 44. The heater tongue 31 is moved into space 49 into the space formerly occupied by upper block section 56 and head 16 is raised exposing exit slot 48. Pneumatic cylinder 35 lifts joint press head 42 thereby forcing contact of leading and trailing edges of baleband 50 with top and bottom of heater tongue 31 which contains two (2) thermoelectric heaters maintaining 600 degrees F. and bottom of contact plate 44. After momentary forced contact the joint press head 42 is lowered to home position. The tongue 31 is then retracted. The high pressure hydraulic cylinder 34 pushes the trailing portion of the baleband 58 upward shearing off the lower portion against cutter 41 and pressing the baleband ends tightly against anvil head 44 resulting in a sealed joint. Once the seal is secured in place, the package is moved via conveyor system 13.

Figure 8:
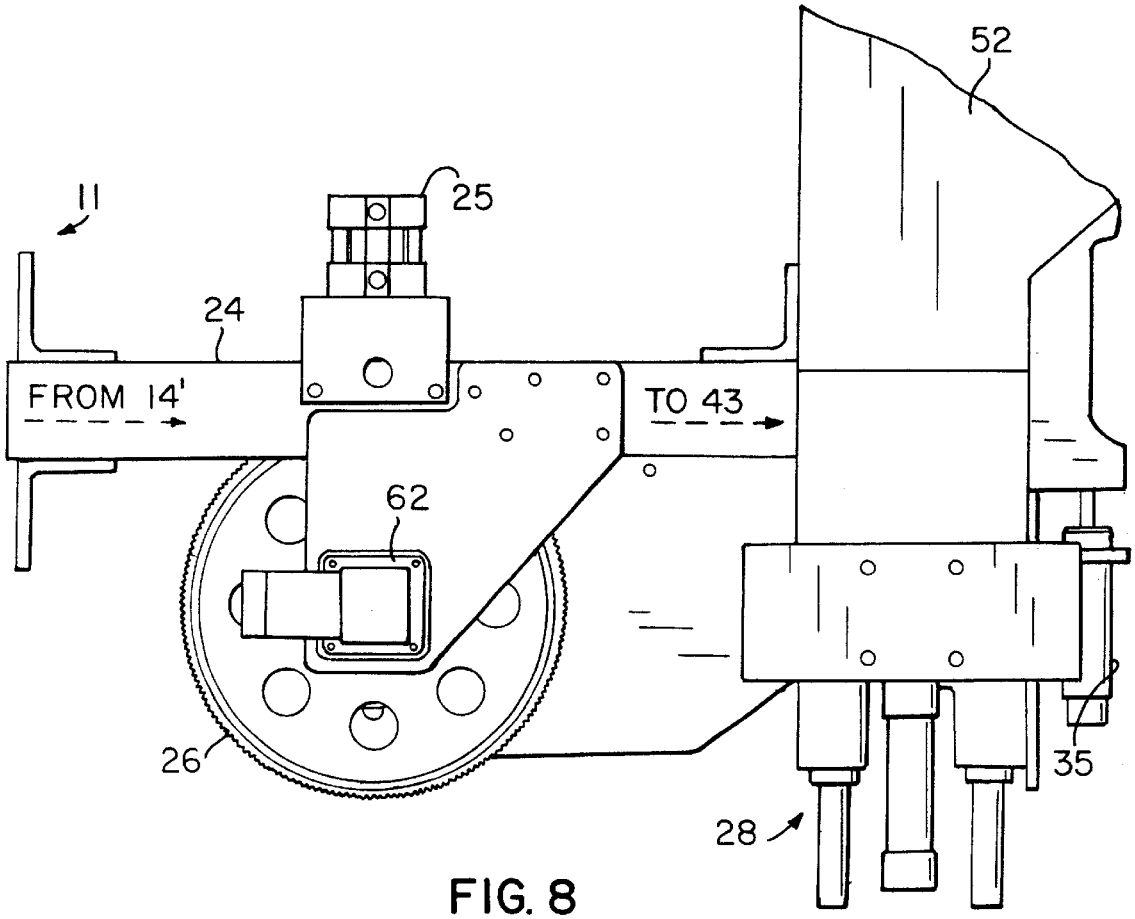
FIG. 8 is a side elevation illustration of the feed system of the banding machine of FIGS. 1–2.

FIG. 8 illustrates in a pictorial diagram the feed system. Nip cylinder 25 causes engagement between engaging wheel 26 and the cylinder 25 including one or more rollers to form a nip to grasp baleband 58 being directed from the unwind/ load systems 11, 14. An optical encoder 62 is mounted to measure rotation of motor 27 and wheel 26 (clockwise for feed; counterclockwise for pullback).

Figure 9:
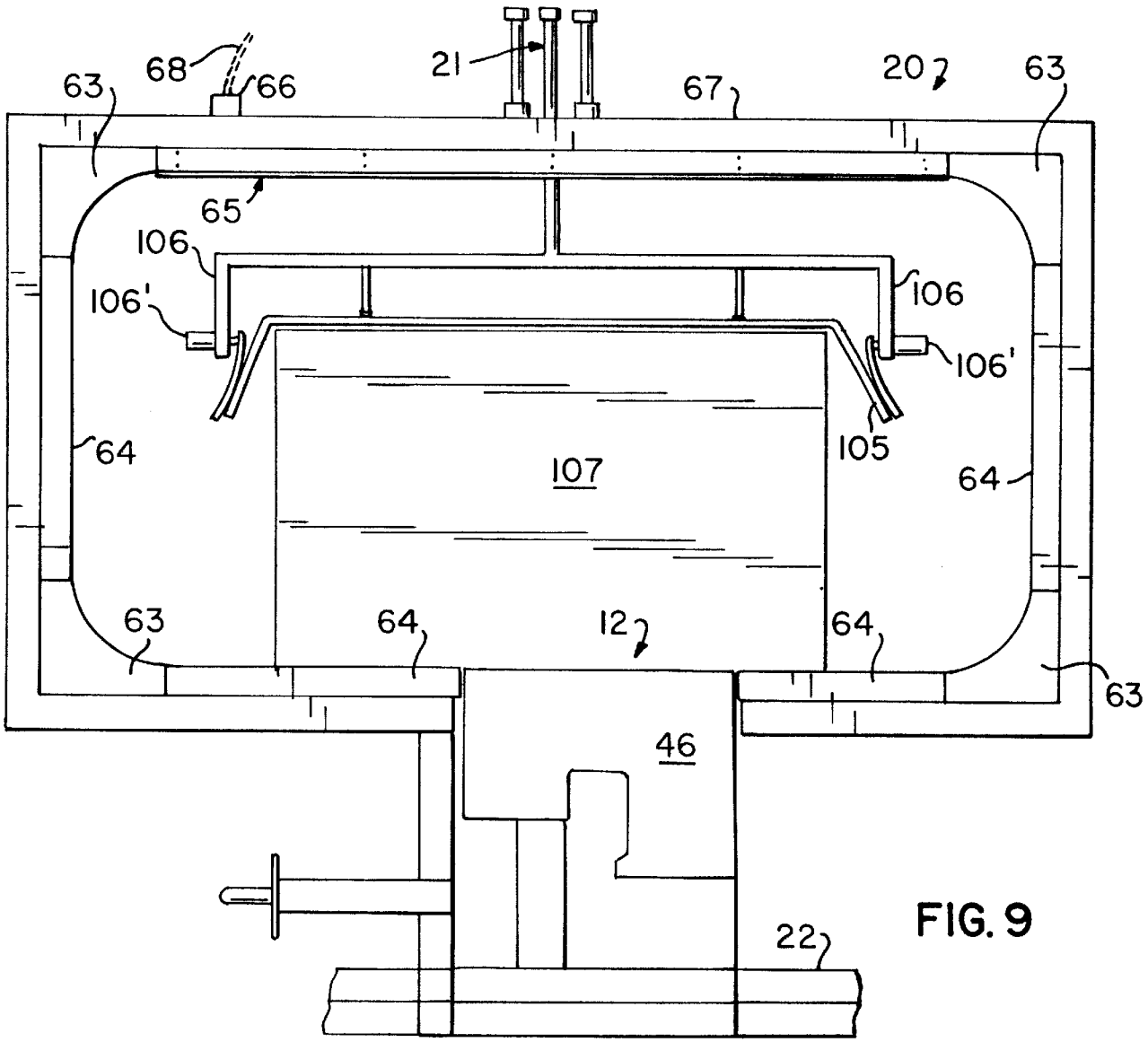
FIG. 9 is a side elevation of the track assembly of the banding machine of FIGS. 1–2.
Figure 10:
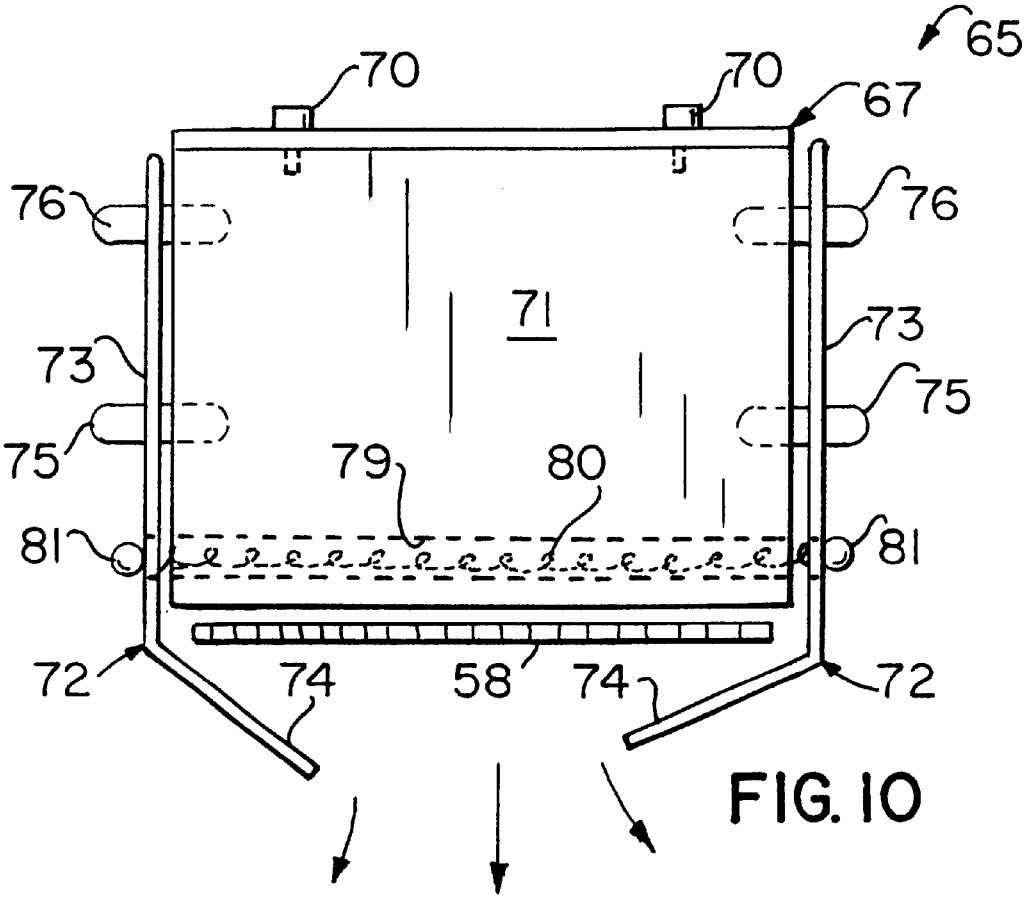
FIG. 10 is a cross-sectional diagram of the upper portion of track assembly of FIG. 9.
Figure 11:
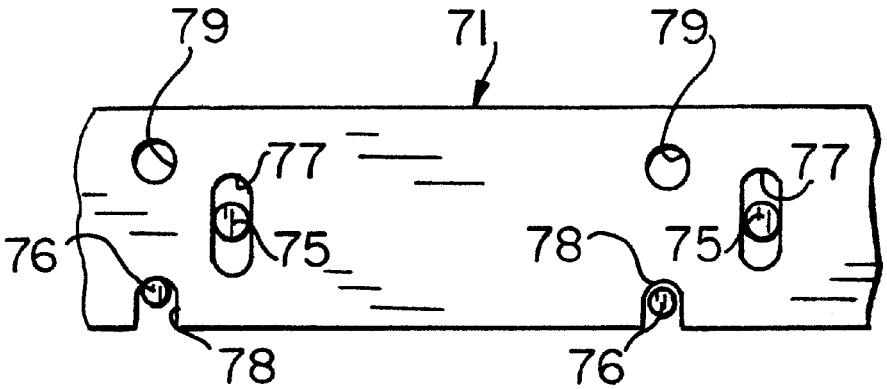
FIG. 11 is a partial side elevation view of the upper portion of the track assembly of FIG. 10.

FIGS. 9–11 illustrate the track assembly 20. A rectangular frame 67 supports upper and lower straight track sections 64, curved corner sections 63, and an upper track assembly 65. Water from hose 68 is injected onto baleband 58 via injector 66, which results in the wetting of the underside of upper leading edge portion 59 (FIG. 7) for a length of about three inches.

The upper and lower track assembly 65 and 64 is illustrated in more detail in FIGS. 10 and 11. Bolts 70 are used to hang support member 71 from frame 67. The support member 71 has two flexible covers 72 mounted along each side via pins or post members 75 and 76 to inhibit movement of cover sides 73 as baleband 58 is pulled away from the support member 71. Flaps 74 are movable outwardly to allow baleband 58 to be "peeled" away from support member 71 but are designed to fold horizontally to support baleband 58 before pullback. Spring 80 is mounted through the support member 71 walls through passageway 79 on stops 81 to provide for spring return of the cover walls 73 to the position shown adjacent the support member 71. The slots 78 and 77 are slightly elongate to allow for a minimum outward movement of walls 73 during pullback and sealing operations. The number of posts 75, 76 slots 77, 78 and springs 80 depend upon the length of track assemblies 65 and 64.

Figure 12:
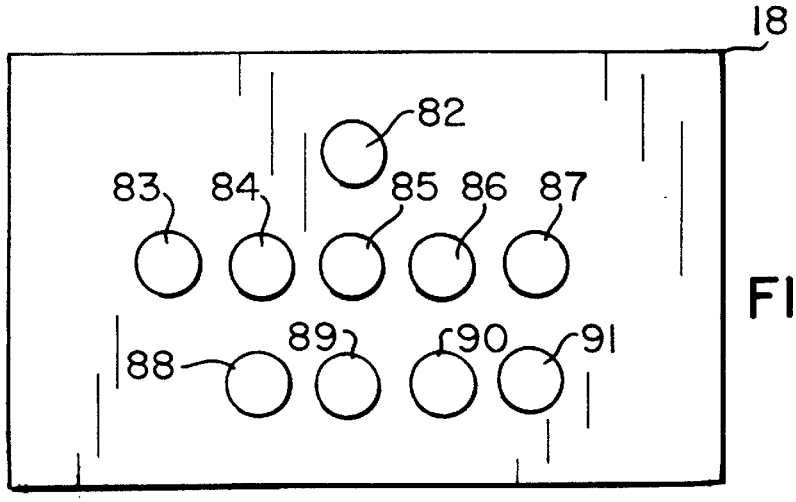
FIG. 12 is a pictorial view of the front panel electrical controls of the banding machine of FIGS. 1–2.

FIG. 12 illustrates the front panel controls of system 18: emergency stop 82: lights when pushed and isolates power to all prime movers external of the electrical enclosure 18. auto track load function 83: momentary contact switch which initially loads track 20 with baleband 58 when system is loaded the first time. manual strap function 84: momentary contact switch which activates the manual baling function when system is in manual operation. manual/auto 85: two position switch which changes system from auto to manual and opposite. main power 86: isolates 110vac power. number of straps, 1, 2, 3, 87: auto function determines the number of straps per side per bale. fault light 88: flashes coded sequence of lights during fault conditions. hydraulic pump start 89: provides start signal to hydraulic pump 17'. hydraulic pump stop 90: provides stop signal to hydraulic pump 17'. conveyor fwd/rev 91: controls mill conveyor 13 movement during manual operation.

Figure 13:
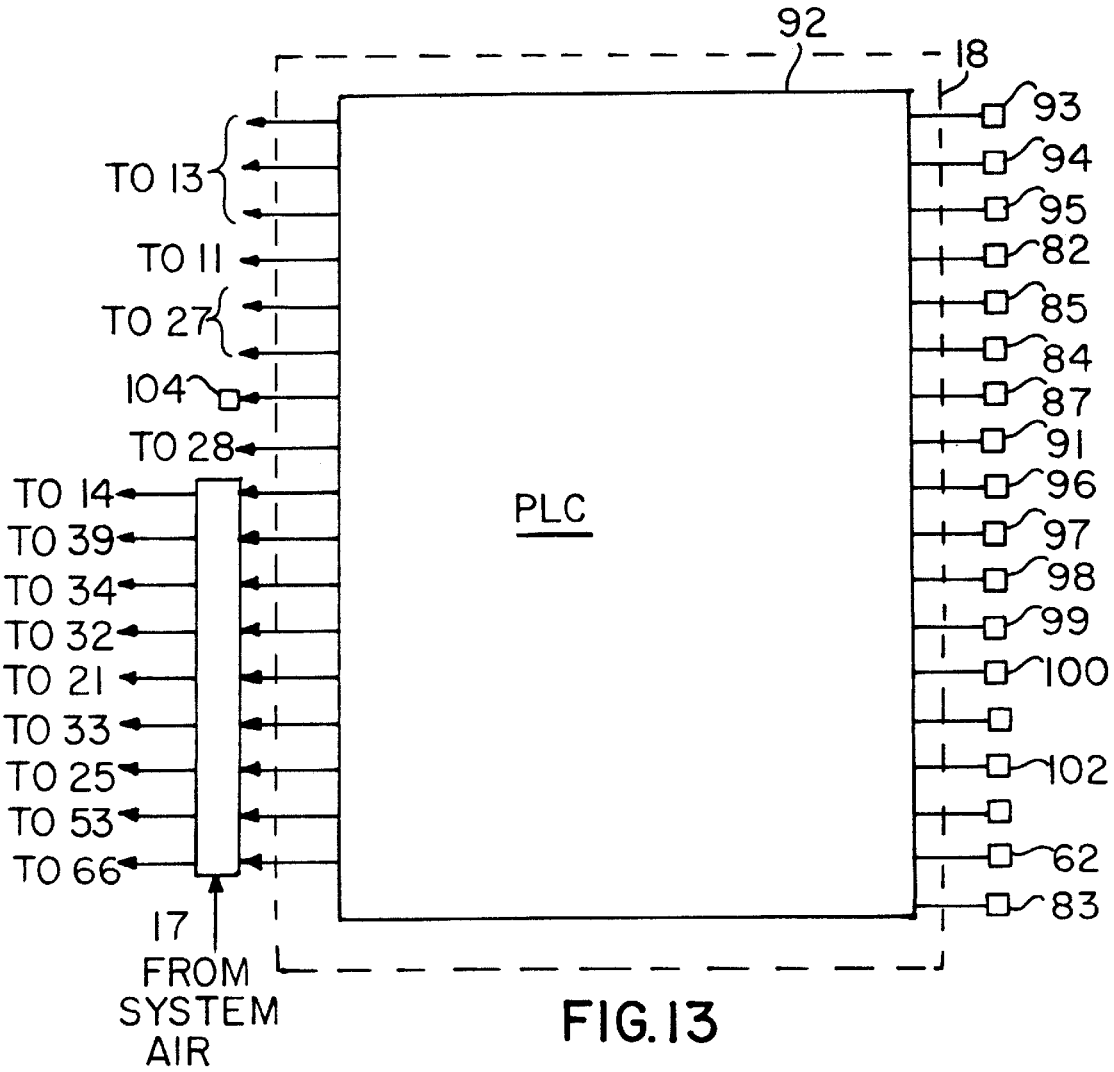
FIG. 13 is a block diagram showing the electronic controller of the banding machine.

FIG. 13 is a diagram of the operating inputs and outputs of programmable logic controller (PLC) 92. Inputs include bale approach limit switch 93 from conveyor system 13; conveyor encoder 94 from conveyor 13; exit conveyor ready limit switch 95; sealing head 16 lowered sensor 96; heater tongue 31 fully retracted sensor 97; loop magazine deficient limit switch 98; rear brake cylinder actuated sensor 99; front brake cylinder actuated sensor 100; baleband supply roll radius indicator 102; and other switches or sensors as indicated.

Outputs from PLC 92 include electrical control of the nine valves in air distribution header 17 that supply system air pressure to the devices indicated. The outputs to the mill conveyor 13 include conveyor forward; conveyor reverse; and a flag to indicate system 10 is ready to perform bale functions. Output to unwind system 11 is for a hydraulic flow control valve to the unwind motor. Outputs also control feed motor 27 direction; main lift head press assembly 28; and joint head press return solenoid 104.

With respect again to FIG. 9, the package 107 to be wrapped with baleband 58 is shown in relationship to a paper bale wrapper 105 and top press arms 106 that include double-acting air cylinders 106 supplied from hoses 69 (FIG. 1) that fold wrapper 105 downwardly. The top press 106 is used to pre-fold the wrapper 105 to hold it securely during pullback. Excessive pullback will trigger a fault indication due to excessive turning of feed motor 27 in reverse. Assembly 21 is pneumatically operated from air header 17 via PLC 92 (FIG. 13).

The improvements of the present system over prior machines includes the following:

1. The present system is a bottom tye machine. This feature allows for packages with cover wrapping draped over the top to pass through the machine. This feature is also less dependent upon the exact position of the package on the conveyor. Also, this feature provides that the sealing head apparatus tucks downwardly below the top plane of the conveyor and out of the way.

2. The present system uses no added glue. Heat and water is applied to baleband that already has water-soluble glue in it as part of the manufacturing process. Water is presently applied. In some cases atmospheric humidity may be sufficient to activate glue.

3. The system features include multi-strap applications around a bale. Presently, the system provides for either one, two, or three bands per package.

4. The present solution is a precision machine. There is hydraulic or pneumatic control of all prime movers. The system includes no friction clutches, belts, pulley, or electric motors. This feature provides for a cutting operation that leaves no unattached tail on the outside of the sealed joint. This feature is very important for a joint that has great tensile strength but relatively little "peel" strength.

5. The use of the load and unwind apparatus provides for a baleband strap that is preloaded and properly tensioned for fast and efficient operation. Several of the variables involved in this regard are adjustable to accommodate different conveyors and other apparatus supplied by the mill in which the present machine operates.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A banding machine for cooperation with and between an upstream and a downstream horizontal conveyor upon which loose bales of material are moved to be wrapped into tight bales comprising a support frame locatable transversely with respect to a longitudinal direction of the conveyors and between the conveyors, said banding machine including an arched track having spaced vertical and horizontal members for guiding a band transversely and completely around a loose bale disposed within said arched track, said banding machine including a sealing station adjacent one of said horizontal members and having an automatic means for selectively gripping a forward end of a band, said sealing station having a reversible drive wheel for driving a band forward through said track with an overlap of a band located adjacent one of said vertical members and for applying reverse force to tighten a band around a bale of material after actuation of said automatic means for selectively gripping, said sealing station having means for connecting overlapped end portions of a band after tightening a band about a bale, said means for connecting including means for applying heat to inner facing surfaces of overlapped portions of a band and means for forcing overlapped portions of a band toward said means for applying heat, while heat is being applied to overlapped portions of a band, said sealing station having means for cutting overlapped end portion of a band, means for clamping overlapped end portions of a band together to firmly secure a band about a bale of material.

2. The banding machine of claim 1 wherein said reversible drive wheel is located adjacent an inner surface of a band, and further including at least one movable surface located adjacent an outer surface of a band, said at least one movable surface being selectively movable toward and away from said drive wheel to grip and release a band.

3. The banding maching of claim 1 wherein said means for clamping overlapped end portions of a band includes a plate located outwardly of a band encircling a bale of material and a pressing head disposed inwardly of a band generally opposite to said plate, said sealing station having a horizontal exit slot for a band between said plate and said pressing head opening toward a downstream movement of a bale from said machine by one said conveyor causing a band encircling a bale of material to move out through said exit slot.

4. The banding machine of claim 1 further including means for applying water to a portion of a band, said water cooperating with adhesive in a band for securing overlapped portions of a band together.

5. The banding machine of claim 1 wherein said means for applying heat includes a movable heater element selectively positionable between overlapped end portions of a band.

6. The banding machine of claim 5 wherein said means for forcing overlapped portions of a band into engagement with said heater element positioned between overlapped portions of a band.

7. The banding machine of claim 6 wherein said sealing station includes control means for operating said heater element to move said heater element from between overlapped portions of a band before said means for cutting is operated.

8. A method for tying a bundle of material which comprises the steps of:

A. encircling a bundle of material with a length of flat baleband having a leading end portion, a trailing end portion partially enclosed in a movable sealing head station and a center portion in an arched track located concentrically above and away from the bundle of material;

B. clamping the leading end portion to restrain rearward movement of the band and pulling the trailing end portion of the band to concentrically collapse the band from the arched track onto the bundle with the trailing end portion of the band overlapping the leading edge portion;

C. clamping the trailing end portion to prevent loss of tension in the band;

D. moving a heated element between the leading and trailing portions of the band;

E. applying forces to the leading and trailing portions of the band into engagement with a heated element sandwiched therebetween to aid in heat transfer from the element to the leading and trailing portions of the band;

F. removing the forces and retracting the heated element from between the leading and trailing portions of the band and;

G. clamping the overlapped portions of the band together to form a seal with a hardened flat press in a manner to shear cut the trailing portion of the band adjacent the seal.

9. The method of claim 8 wherein the band is of repulpable paper fibers and contains an adhesive that is water-soluble, further including the step of:

H. applying water to a facing side of the leading end portion during step A.

10. A banding apparatus for cooperation with and between an upstream and a downstream horizontal conveyor upon which loose bales of material are moved to be wrapped by said apparatus into tight bales comprising a support frame adapted and arranged to be disposed to a longitudinal direction of and between an upstream and a downstream conveyor, a banding machine mounted on said support frame, a supply of a stiff flat band of repulpable paper fibers held together with water-soluble adhesive and having a forward end portion with inner and outer surfaces, said banding machine including an arched track having spaced vertical and horizontal members for guiding said band transversely and completely around a loose bale of materials disposable within said arched track, sealing means adjacent one said horizontal member for connecting said band to itself, means for applying water to said forward end portion of said band prior to arrival at said sealing means, said sealing means including means for selectively gripping said forward end portion of said band after passing completely through said arched track, said sealing means including a reversible drive wheel for driving said band forward through said track with an overlap of said band adjacent one said vertical member and for applying reverse force on said band to tighten said band around a bale of material after actuation of said means for selectively gripping, said sealing means further including means for clamping together said forward end portion and a trailing end portion of said band overlapped therewith and after tightening thereof, said clamping means including means for cutting said band before said overlapped end portions are tightly secured by said adhesive therebetween.

11. The apparatus of claim 10 wherein said sealing means includes a heater element for heating at least one of said overlapped end portions of said band.

12. The apparatus of claim 11 wherein said sealing means including control means for moving said heater element to a position between said overlapped end portions of said band for heating said forward end portion and for removing said heater element from between said overlapped end portions of said band before said means for clamping secures said overlapped end portions.

13. The apparatus of claim 12 wherein said control means includes means for removing said heater element from between said overlapped end portions of said band before said means for cutting cuts said band.

14. The apparatus of claim 10 wherein said track includes a support member and movable covering means attached to said support member for removably retaining said band adjacent said support member.

15. The apparatus of claim 10 further including vertical lifting means for selectively moving said sealing means vertically.

16. The apparatus of claim 10 wherein said means for clamping includes a plate located adjacent said outer surface of one of said overlapped end portions of said band and a pressing head adjacent said inner surface of another of said overlapped end portions of said band, said sealing means having a horizontal exit slot for said band disposed about a bale opening in a downstream direction of movement of a bale whereby movement of a bale by said downstream conveyor causes said band encircling a bale to move out through said exit slot.

17. The apparatus of claim 16 wherein said means for gripping includes a selectively operable brake member for selectively securing said forward end portion of said band between said brake member and said plate.

18. The apparatus of claim 17 wherein said means for gripping includes a second selectively operable brake member for selectively securing said trailing end portion between said second brake member and said plate.

19. The apparatus of claim 10 wherein said reversible drive wheel is located adjacent said inner surface of said band, a movable engaging surface located opposite to said drive wheel adjacent said outer surface of said band, said engaging surface being automatically movable toward and away from said band and said reversible drive wheel to grip and release said band.

20. The apparatus of claim 10 wherein said sealing means includes automatic control means for controlling said movable engaging surface gripping said band, and said means for clamping, and said means for cutting.

* * * * *